US006837813B2

(12) United States Patent
Darnell

(10) Patent No.: US 6,837,813 B2
(45) **Date of Patent: *Jan. 4, 2005**

(54) OPEN CENTER RETURNING FLYING POLYGON

(76) Inventor: John H. Darnell, 3948 Wistman La., Myersville, MD (US) 21773

( * ) Notice: Subject to any disclaimer, the term of this patent is extended or adjusted under 35 U.S.C. 154(b) by 0 days.

This patent is subject to a terminal disclaimer.

(21) Appl. No.: 10/233,163

(22) Filed: Aug. 30, 2002

(65) Prior Publication Data

US 2003/0092515 A1 May 15, 2003

Related U.S. Application Data

(63) Continuation-in-part of application No. 09/703,242, filed on Nov. 3, 2000, now Pat. No. 6,443,862

(60) Provisional application No. 60/163,176, filed on Nov. 3, 1999.

(51) Int. Cl.[7] ..... A63B 65/08

(52) U.S. Cl. ..... 473/590; 446/46

(58) Field of Search ..... 473/588, 589, 473/590; 446/46, 48

(56) References Cited

U.S. PATENT DOCUMENTS

| | | | | |
|---|---|---|---|---|
| 2,324,022 A | * | 7/1943 | Prause, Jr. | 473/590 |
| 4,203,249 A | * | 5/1980 | Bohm | 473/590 |
| 4,307,535 A | | 12/1981 | Martin | 46/74 D |
| 4,479,655 A | | 10/1984 | Adler | 273/425 |
| 4,946,173 A | | 8/1990 | Schlegel et al. | 273/425 |
| 5,213,539 A | | 5/1993 | Adler | 446/48 |
| 6,443,861 B1 | * | 9/2002 | Foulke | 473/590 |
| 6,443,862 B1 | | 9/2002 | Darnell | 473/590 |

* cited by examiner

*Primary Examiner*—Steven Wong
(74) *Attorney, Agent, or Firm*—Charles N. Quinn

(57) ABSTRACT

A throwable toy includes an open center polygon defining a closed ring having upper and lower surfaces including connected linear segments and a plurality of shortened, generally rounded, rearward-projecting members extending outwardly and downwardly from said ring along and aligned with the axes of said linear segments.

26 Claims, 4 Drawing Sheets

OPEN CENTER RETURNING FLYING POLYGON

CROSS REFERENCE TO RELATED PATENT APPLICATIONS

This application is a continuation-in-part of U.S. patent application Ser. No. 09/703,242 filed Nov. 3, 2000, now U.S. Pat. No. 6,443,862 issued Sep. 3, 2002, which claimed priority from U.S. provisional application No. 60/163,176, filed Nov. 3, 1999, both of which are incorporated by reference herein.

SUMMARY OF THE INVENTION

This invention provides an open center polygon forming a closed ring having numerous linear segments, and preferably having short, rounded, rearward-projecting extension members or tabs extending from those linear segments. The closed ring has upper and lower surfaces which are asymmetrical respecting one another. The upper surface is considered to be the surface facing away from the ground when the ring is thrown by a user, rotates during flight and returns to the user. During a normal flight pattern the open center returning flying polygon, as it flies, rotates about an axis which desirably remains in a generally upward orientation; it is with respect to this axis that the "upper" and "lower" surfaces of the open center returning flying polygon are defined for disclosure and discussion purposes herein.

Each linear segment preferably has radially outwardly facing blunt edge forming the leading edge of an airfoil, having a continuously varying angle of attack along the airfoil length, with the radially inwardly facing edges defining the trailing edge of the airfoil of each segment conforming to a single plane together with the radially inwardly facing edges defining the trailing edges of the airfoils of all of the other segments.

The outer leading edge of the airfoil of each segment, along the linear length of the segment excluding the tab portion, preferably varies in elevation and position preferably above and relative to the plane of the trailing edge. Exceptions are the tabular extensions, which preferably fall below the plane defined by the interior trailing edge of the linear segments.

The upper surface of each segment has a configuration much like the upper surface of a conventional wing; however, the angle of attack of the airfoil and hence the shape of the upper surface desirably varies with longitudinal length along each segment.

In contrast to the upper surface of each segment, the underside of each segment is quite unlike the underside of a conventional airfoil. The underside of each segment presents a somewhat concave surface facing downwardly, as the open center returning flying polygon is thrown and returns to the user. The configuration of the under or bottom side of each segment at the position adjacent to the outer peripheral of the segment has somewhat of a "undercut" appearance.

In one variation, the open center polygon forming a closed ring having numerous linear segments may be equipped with curled edges such that the leading edge of each linear segment is curled downwardly to be positioned under the airfoil, resulting in a structure having a "C" shape cross section, which is generally thinner in cross section and therefore lighter in weight than that identified as the preferred embodiment of the invention in the parent application hereto. The curled edge facilitates addition of ballast, preferably in the form of flexible ballast strips which do not effect the aerodynamic profile of the open center returning flying polygon and which may be added incrementally to increase the weight of the open center returning flying polygon. This results in increased range of the open center returning flying polygon, improved performance of the open center returning flying polygon under windy conditions and, if fabricated from glow-in-the-dark materials, may allow night use of the open center returning flying polygon. Addition of such ballast generally results in the open center returning flying polygon being easier for inexperienced users to throw and to manipulate than a conventional boomerang.

In a further variation, the open center returning flying polygon of the invention may be fabricated in an extremely small configuration, which is too small to handle and to launch manually. In such case a mechanical miniature launcher is provided which duplicates the gripping motion of the human hand when used to launch the full size version of the open center polygon disclosed in the parent application hereto. When fabricated in such small size, the open center returning flying polygon is extremely light in weight, resulting in extremely low impact force in the event the open center returning flying polygon is involved in a collision, such as with furniture when used in an indoor setting. When fabricated in the extremely small size, the open center returning flying polygon has an extremely short range, typically on the order of about six feet of distance for travel from the thrower until the open center returning flying polygon begins its return. This permits the open center returning flying polygon when fabricated in such embodiment to be used safely in indoor settings.

In still another embodiment the open center returning flying polygon may be fabricated in a large diameter, preferably in the order of from two to three feet in diameter, and may be used much as the familiar "Hula Hoop" toy when not being thrown. In such case, the open center returning flying polygon is preferably fabricated in tubular form with the tube being hollow in cross section. In this manifestation of the invention, the open center returning flying polygon preferably has relatively thick, relatively blunt edges and relatively round vertices and tabular projections as compared to those disclosed respecting the preferred embodiment shown in the parent application hereto.

In still another embodiment the open center returning flying polygon may be fabricated in a compact form differing from the structure disclosed as the preferred embodiment in the parent application hereto by being capable of being disassembled into separate segments with each segment having a hollow socket on one end and a matching locking protrusion on the other end for fitting with adjacent segments. This disassembleable characteristic enables the open center returning flying polygon to be stored very compactly.

In still another embodiment the open center returning flying polygon is fabricated as an essential mirror image of the returning flying polygon disclosed as the preferred embodiment in the parent application hereto. In use this mirror image open center returning flying polygon is preferably launched by a right handed person using a backhand motion much the same as that involved in throwing a conventional "Frisbee" toy. When thrown in such manner, this mirror image open center returning flying polygon spins in a direction reverse from that of the returning flying polygon disclosed as the preferred embodiment in the parent application hereto when that returning flying polygon is thrown in a normal overhand manner by a right handed person. When thrown in such manner, the mirror image open center returning flying polygon returns to the thrower, traveling in a circular counterclockwise path much like the returning flying polygon disclosed as the preferred embodiment in the parent application hereto.

In still another aspect of the invention the open center returning flying polygon may be fabricated having a number of sides differing from the returning flying polygon disclosed as the preferred embodiment in the parent application hereto, and further may be fabricated in a variety of sizes making possible a nested set of open center returning flying polygons, which set could be molded in a single operation.

In all of its embodiments the invention preferably provides a light weight open center returning flying polygon having rounded edges and projections which trail with respect to the rotation of the polygon and further provides a cambered airfoil having a varying angle of attack. The non-circular version of the polygon may be provided in any polygonal shape having three or more sides.

When the right-handed versions are thrown overhand in the manner of a conventional boomerang gripped in the right hand, being tilted to the right of vertical and released with sufficient speed and counterclockwise spin in a light, steady breeze coming from the thrower's left, the trajectory of the open center returning flying polygon is nearly level and follows a circular counterclockwise path, with the open center returning flying polygon returning gently to the thrower along the direction of the breeze.

The open center returning flying polygon is an intrinsically safe version of a boomerang, providing a closed ring shape, with projections from each segment being minimal, rounded and trailing. The open center returning flying polygon is preferably formed as a light weight, low impact, flexible yet stable structure. The open center returning flying polygon is user-friendly in that it is easier to master and safer to use than conventional boomerangs.

The aerodynamic design of the open center returning flying polygon overcomes instabilities which are inherent in a ring shape while minimizing drag forces thereby effortlessly yielding spectacular performance with light weight.

The ring shape and cambered airfoil provide intrinsically stable geometry permitting the use of thinner and lighter material, leading to low impact force in the event of a collision. This further permits safe use of the returning flying polygon in groups of people with the ring shape making the returning flying polygon easy to catch yet highly visible and providing a dramatic appearance in flight. The open center returning flying polygon is even well adapted to use indoors.

The number of segments may vary upwards from three (3).

A circular configuration is also within the purview of the invention.

DESCRIPTION OF THE PREFERRED EMBODIMENTS AND BEST MODE KNOWN FOR PRACTICING THE INVENTION

Figure 1:
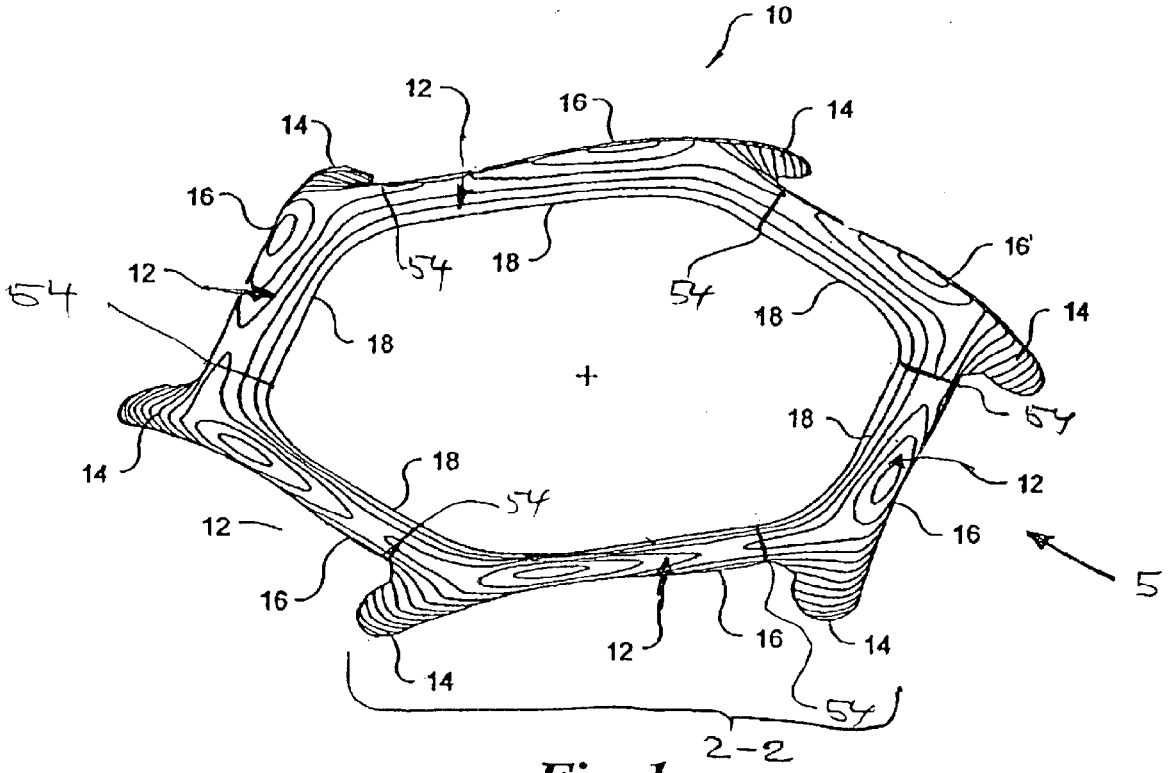
FIG. 1 is an isometric drawing of a open center returning flying polygon in accordance with one preferred practice of the invention, lined to indicate surface contours.
Figure 2:
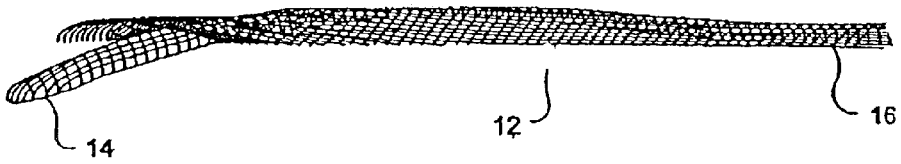
FIG. 2 is a broken elevation of a portion, denoted generally by bracket 2—2 in FIG. 1, of the open center returning flying polygon illustrated in FIG. 1, cross-hatched to illustrate surface contours.

Referring to the drawings in general and to FIG. 1 in particular, a returning flying polygon in accordance with one preferred embodiment of the invention is illustrated in FIG. 1 and designated generally 10. Returning flying polygon 10 includes a plurality of preferably identical linear segments, which are configured to define a generally hexagonal shape in the embodiment illustrated in FIG. 1, with each linear segment being identified 12. Extending rearwardly and somewhat downwardly from each segment 12 is a rearwardly protecting tab 14. Each linear segment 12 includes an airfoil leading edge 16 which defines the outer periphery of the open center returning flying polygon 10 along the longitudinal lengths of the straight portions of linear segments 12. Each linear segment 12 also includes an airfoil trailing edge 18 which defines the inner periphery of open center returning flying polygon 10. Linear segments 12 are preferably manually separable and reconnect able to one another at lines of juncture 54 in FIG. 1. Frictional plug-socket construction is preferred.

Figure 3:
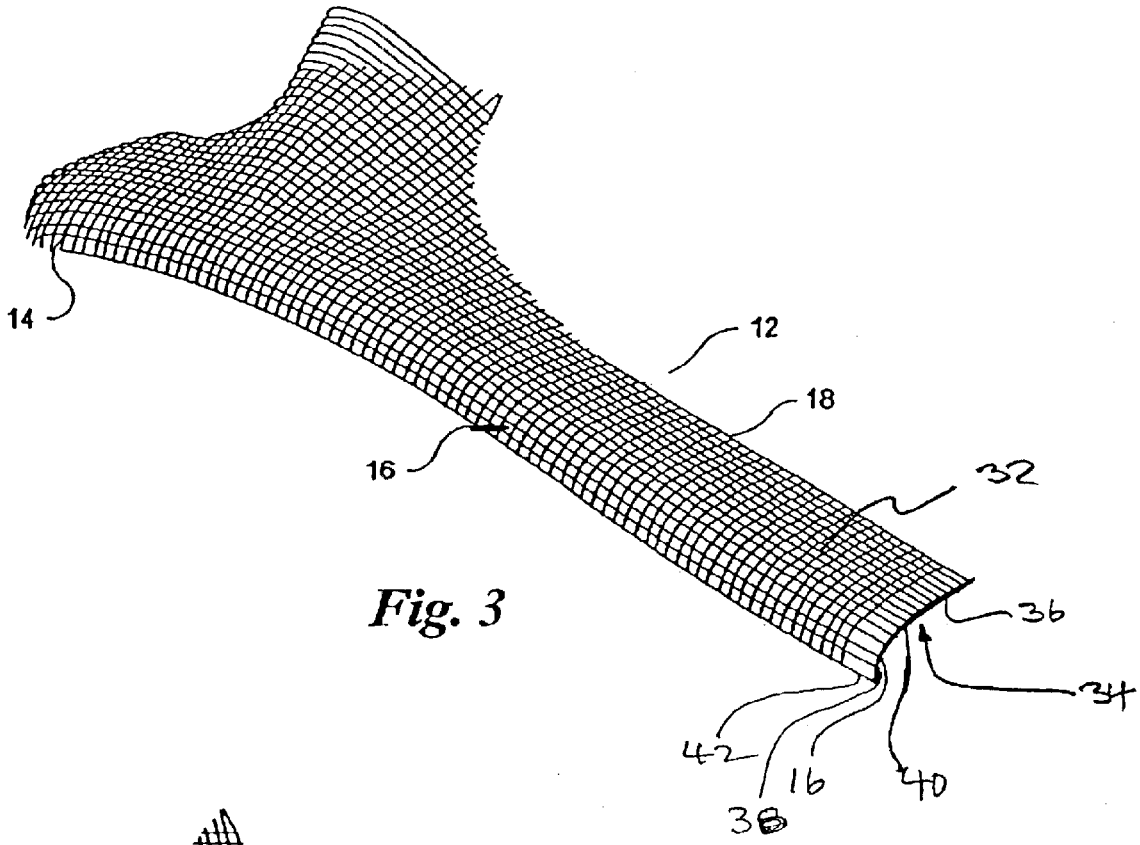
FIG. 3 is a broken isometric view of a portion of one linear segment of the open center returning flying polygon depicted in FIGS. 1 and 2, cross-hatched to illustrate surface contours.
Figure 4:
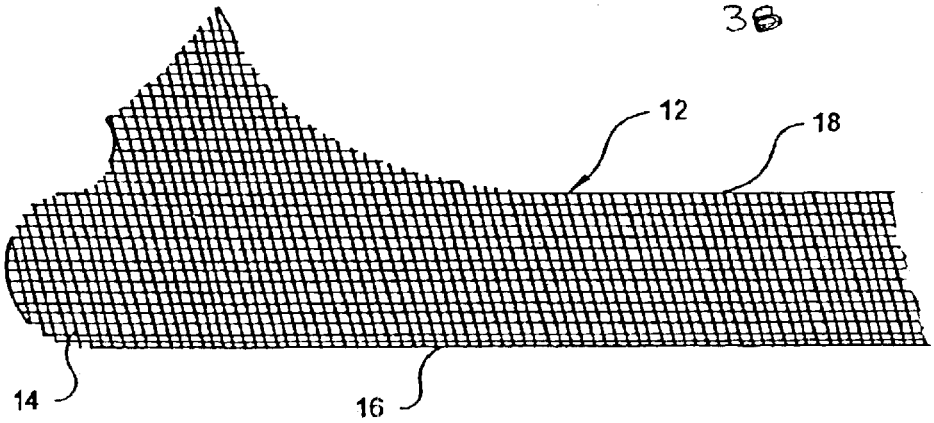
FIG. 4 is a broken top view of the structure illustrated in FIG. 3, cross-hatched similarly to FIG. 3 to illustrate surface contours.

Airfoil leading edge 16, airfoil trailing edge 18 and the shell-like homogeneous construction of segments 12 are illustrated in FIGS. 3 and 4.

In FIG. 3 the upper surface of linear segment 12 has been designated 32 while the lower surface of linear segment 12, which cannot be seen in FIG. 3, is indicated by arrow 34. In FIG. 3 the transverse cross section of linear segment 12 is designated 36.

Upper surface 32 has the familiar convex shape of the upper surface of a conventional airfoil as readily seen from FIG. 3. Hence, surface 32 provides a lift component when open center returning flying polygon 10 is thrown. However, lower surface 34 does not at all resemble the familiar lower surface of a conventional airfoil such as a conventional aircraft wing. Lower surface 34 is concave, as apparent from FIG. 3.

Open center returning flying polygon 10 is preferably fabricated from a single homogeneous piece of plastic and is relatively thin, being preferably from about 0.005 to about 0.030 inches in thickness. In one preferred implementation of the invention, open center returning flying polygon 10 has had an overall diameter of about 11¾ inches, measured from tip to tip across diagonally opposite rearwardly projecting tabs 14. In such implementation, linear segments 12 have been about 4 inches long at the position indicated by dimensional arrow XX in FIG. 6 and have been about 5¼ inches long at the position indicated by dimensional arrow YY also in FIG. 6. In such implementation linear segments 12 have been about 0.875 inches in width as indicated by dimensional arrow WW in FIG. 6. In this implementation the open center returning flying polygon has been fabricated from a homogeneous piece of high impact plastic with a uniform thickness of about 0.010 inches.

The configuration of airfoil leading edge 16 may include a slight lip extending the longitudinal length of a linear segment 12 where the lip has been denoted 38 in FIG. 3.

Airfoil leading edge 16 defines the radially outer extremity of open center returning flying polygon 10 along linear segments 12. However, airfoil leading edge 16 is not necessarily coincident with a lower extremity 42 running along the radially outward portion of a linear segment 12 as illustrated in FIG. 3, particularly at the transverse cross section 36 of linear segment 12 where lower extremity 42 of the forward or leading edge of linear segment 12 is illustrated as being below and slightly inboard of the position of leading edge 16 of the airfoil.

Figure 5:
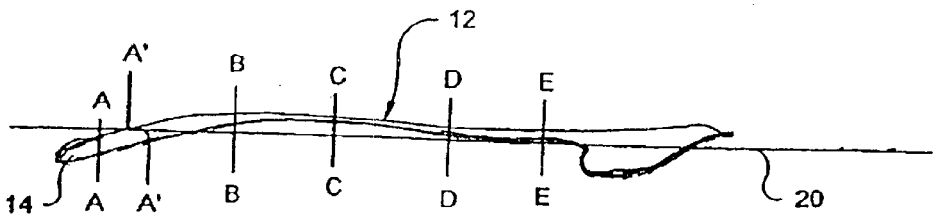
FIG. 5 is a side view looking radially inwardly respecting the segment of the open center returning flying polygon depicted in FIG. 1, taken in the direction of arrow 5 in FIG. 1, with the plane defined by the interior trailing edges of the linear segment airfoil depicted by a straight line.
Figure 6:
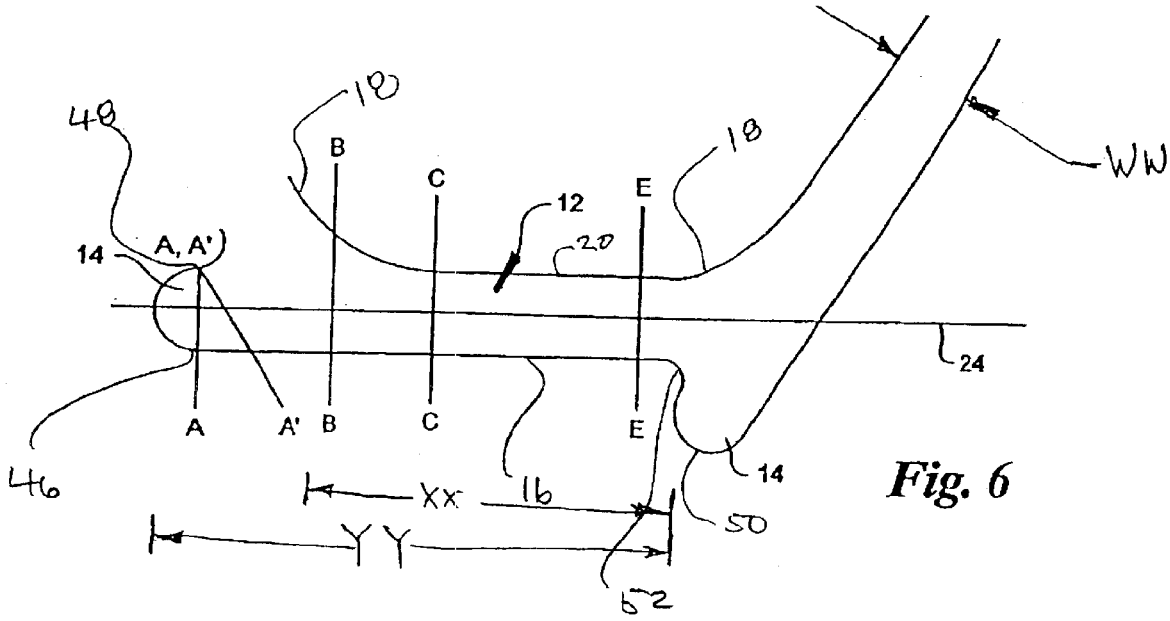
FIG. 6 is a top view of the linear segment of the open center returning flying polygon depicted in FIG. 5, with part of an adjoining segment also shown.
Figure 7:
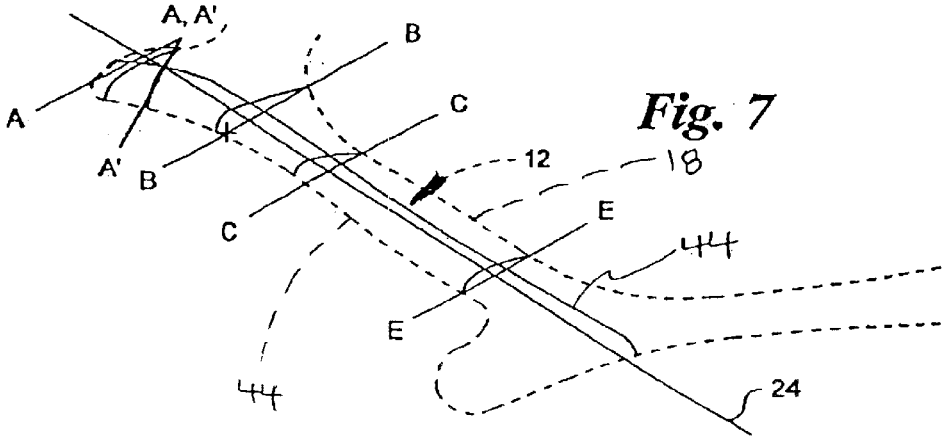
FIG. 7 is a perspective view, in dotted lines, of the linear segment of the open center returning flying polygon shown in FIGS. 5 and 6, depicting configuration of portions of the linear segment of the open center returning flying polygon illustrated in FIGS. 5 and 6 at corresponding alphabetically identified lines.
Figure 8:
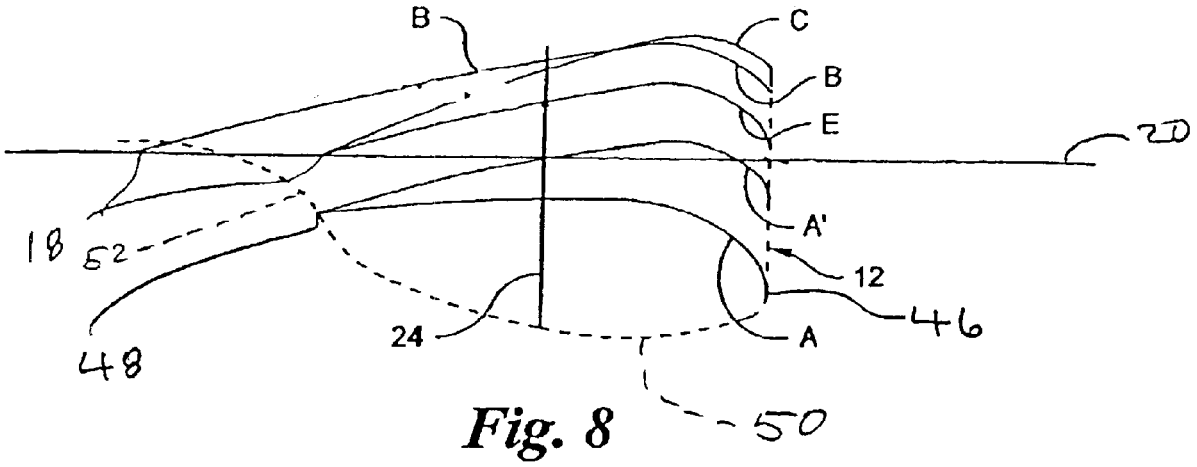
FIG. 8 is a view of the configurations depicted in FIG. 7 in a direction parallel to the longitudinal axis of the linear segment.

FIG. 5 includes a number of position lines identified by alphabetic characters A, A', B, C, D and E. These position lines depict positions at which the configuration of a linear segment 12, including the airfoil shape, is shown in FIGS. 7 and 8. Lines A—A, A'—A', B—B, C—C and E—E are also illustrated in FIGS. 6 and 7. FIG. 7 depicts the cross-sectional configuration of the linear segment 16 including the airfoil shape of the airfoil leading edge 16 and the airfoil upper surface 32 along linear segment 12 at the locations identified by lines A—A, A'—A', B—B, C—C and E—E. The airfoil configuration defined by the airfoil leading edge 16 and the linear segment upper surface 32 is depicted as a solid line above each of these alphabetically identified position lines. In FIG. 7 line 24 denotes the longitudinal axis of linear segment 12. In FIG. 7 the line 44 has been drawn to identify the continuum of positions along upper surface 32 of linear segment 12 which are immediately above longitudinal axis 24 of linear segment 12. Line 44 and the shape thereof in FIG. 7 helps visualize the configuration of the portion of open center returning flying polygon 10 illustrated in FIG. 7 since the boundaries of polygon 10 have been depicted in dotted lines in FIG. 7.

FIG. 8 similarly illustrates the configuration of the upper surface 32 of the airfoil at lines A—A, A'—A', B—B, C—C and E—E. Line A—A is in tab portion 14 but is taken perpendicularly to longitudinal axis 24 of segment 12 while line A'—A' is taken at an angle to longitudinal axis 24 of segment 12, where the angle is such that line A'—A', when inscribed on the airfoil upper surface as illustrated in FIG. 5, is perpendicular to the airfoil leading edge 46 and to the airfoil trailing edge 48 portion of rearwardly projecting tab 14. In FIG. 8 a transitioning edge of tab portion 14, from leading edge 46 of tab portion 14 to trailing edge 48 of tab portion 14, is denoted 50 and is illustrated in dotted lines. Similarly in FIG. 8 a concave transitioning edge from tab portion 14 trailing edge 48 to adjacent linear segment airfoil leading edge 16 is illustrated in dotted lines and designated 52. Transitioning edges 50, 52 are also illustrated and numbered in FIG. 6.

Still referring to FIG. 8, the downward extension and positioning of rearwardly projecting tab 14 relative to linear segment 12 results in the airfoil leading edge 46 along tab portion 14 being below plane 20 defined by the interior trailing edges 18 of linear segments 12. Plane 20 is illustrated in FIG. 8. Airfoil leading edge 46 at positions A and A prime in FIG. 8 is below plane 20.

As further illustrated in FIG. 8, the position of segment airfoil leading edge 16 along linear segment 12 at locations indicated by lines BB, CC and EE in FIGS. 5, 6 and 7 is above plane 20 defined by interior trailing edges 18. The relative width of a linear segment 12 at positions identified by positioning lines BB, CC and EE in FIGS. 5 and 6 is apparent from FIG. 8 for the position of segment airfoil trailing edge 18 is illustrated at locations CC and EE as being closer to segment airfoil leading edge 16 than at location BB. Similarly, the variance of the angle of attack with longitudinal position along airfoil leading edge 16 is apparent from FIG. 8 where the variation in position of segment airfoil leading edge 16 relative to plane 20 is apparent.

Figure 9:
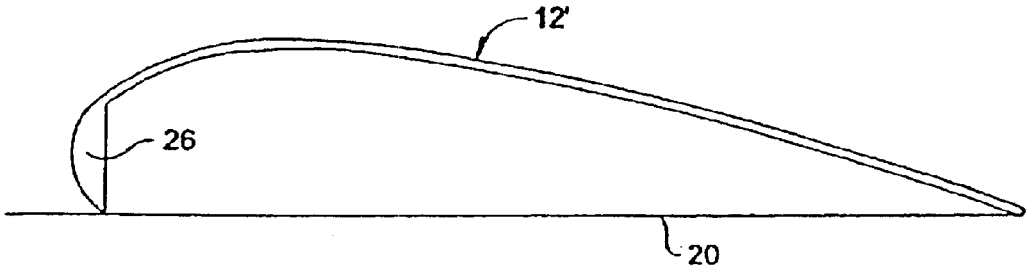
FIG. 9 is an enlarged cross-section of a linear segment of an open center returning flying polygon embodying the invention in an alternate form which is particularly well adapted for mass production.
Figure 10:
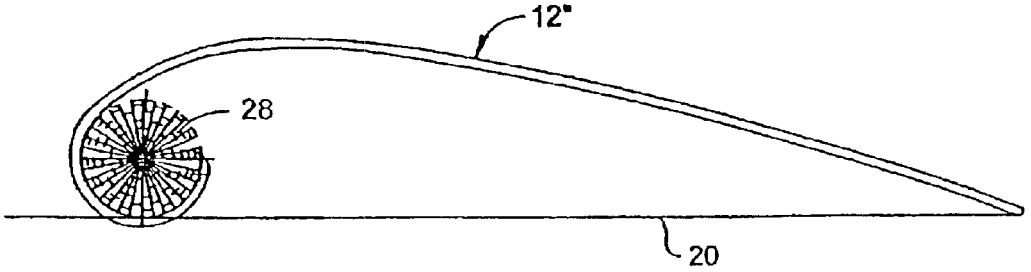
FIG. 10 is an enlarged cross-section, similar to FIG. 9, of a linear segment of an open center returning flying polygon showing a second alternate form of the invention which is also particularly well adapted to be mass produced with the open center returning flying polygon including a ballast stem wrapped in the open center of a linear segment.

FIGS. 9 and 10 illustrate configurations of the returning flying polygon suitable for mass production. In FIG. 9, the airfoil segment 12' is weighted by a section 26 of increased thickness located at the left side in FIG. 9. In FIG. 10, the airfoil segment 12" is weighted by a ballast stem 28 which is preferably molded in place as the returning flying polygon is molded as a single injection molded piece.

In flight, a point during rotation of the open center returning flying polygon when one of linear segments 12 with a radially outwardly facing airfoil leading edge 16 is moving with the perpendicular to the air flow, the linear segment 12 presents a continuously varying angle of attack along the length of the linear segment. When viewed from under surface 32 with the trailing (with respect to rotation) projection or tab 14 at the top end and air flow from the left, the lower end (at the junction with the adjoining linear segment 12) has a neutral (or zero degree) angle of attack increasing to a maximum (approximately 15 degrees) just below juncture with the next linear segment 12, then decreasing to a negative angle of attack at the upper end, at the tip tab 14. All of the airfoil segments inner trailing edges 18 are aligned in common plane 20 and only the outward facing leading edges 16 vary in elevation, except on the rearward projecting tabs 14 where both edges 46, 48 extend below plane 20 of inner edges 18. This feature accomplishes two things:

When a given linear segment 12 has rotated so that it is parallel to the direction of motion, downward slant of trailing tab 14 uniquely produces lift as air flows along the length of the airfoil defined by linear segment 12. Likewise, the longitudinal cross section projects across the forward adjoining linear segment 12 at the point of maximum angle of attack, producing a lifting force at both ends of the linear segment 12 under consideration. The converse is true for the diametrically opposite, parallel linear segment 12 which produces a negative lifting force, though this negative lift is somewhat weaker in magnitude as a result of reduced air flow caused by the associated linear segment 12 rotating opposite to the direction of flight. The combined effect of these forces is equivalent to that which would be produced by a radial tab projecting perpendicularly to the center of the first linear segment. The combined lifting forces at the two diametrically opposed apply a torque to the plane of polygon 10 spin around the axis of flight. Due to gyroscopic precession, this produces a tilt of the plane of spin 90 degrees of motion later, resulting in the desired curved flight path.

Additionally, varying the angle of attack along linear segment 12 produces a neutral angle of attack for the rearward (relative to the direction of polygon spin) projecting tabs 14 with respect to their motion through the air when spinning, as in the hovering descent at the end of a flight. This feature reduces drag on rotation and maintains continuous spin throughout the duration of the flight.

The exact profile of the airfoil segments has been empirically determined and has been found to achieve optimal performance when, for sake of improved safety, the projections are oriented rearward with respect to direction of rotation.

What is claimed is:

1. A throwable returning toy comprising:

a) an open center polygon composed of linear segments; and b) rounded, rearward-projecting members extending outwardly and downwardly from said segments along and aligned with the longitudinal axes of said segments;

c) each segment comprising an outwardly facing airfoil with an outboard surface of each segment defining the airfoil leading edge;

d) wherein said airfoil has varying angle of attack along segment length and wherein said angle of attack varies along segment length.

2. A throwable returning toy comprising:

a) an open center polygon composed of linear segments; and b) rounded, rearward-projecting members extending outwardly and downwardly from said segments alone and aligned with the longitudinal axes of said segments;

c) each segment comprising an outwardly facing airfoil with an outboard surface of each segment defining the airfoil leading edge; and d) wherein said polygon is of uniform thickness except for at said airfoil leading edge and wherein said airfoil leading edge has a crescent shaped cross-section, with the curve of the crescent facing radially outwardly.

3. A throwable returning toy comprising:

a) an open center polygon composed of linear segments;

b) rounded, rearward-projecting members extending outwardly and downwardly from said segments along and aligned with the longitudinal axes of said segments;

c) each segment comprising an outwardly facing airfoil with an outboard surface of each segment defining the airfoil leading edge; and d) a ballast member retained in place radially inboard of said airfoil leading edge by said edge wrapping at least part way around said ballast member.

4. The toy of claim 3 wherein said ballast member is manually replaceable.

5. A throwable returning toy comprising:

a) an open center polygon composed of linear segments;

b) a plurality of rounded, rearward-projecting members extending outwardly and downwardly from said segments along and aligned with the longitudinal axes of said segments;

c) at least some of said segments comprising an outwardly facing airfoil with an outboard edge of each segment defining the airfoil leading edge;

d) lower edge surfaces of said airfoil being curled upon themselves beneath said airfoil leading edges.

6. The toy of claim 5 wherein said members extend from longitudinal extremities of said segments.

7. The toy of claim 5 wherein said airfoil has varying angle of attack along segment length.

8. The toy of claim 7 wherein said angle of attack varies continuously along segment length.

9. The toy of claim 8 wherein said polygon is of uniform thickness except for at said airfoil leading edge.

10. The toy of claim 9 wherein said airfoil leading edge has a crescent shaped cross-section, with the curve of the crescent facing radially outwardly.

11. The toy of claim 9 further comprising a ballast member retained in place radially inboard of said airfoil leading edge by said edge wrapping at least part way around said ballast member.

12. The toy of claim 11 wherein said ballast member is manually replaceable.

13. A throwable toy comprising:

a) an open center polygon of at least three linear segments;

b) a plurality of rounded, rearward-projecting members extending outwardly and downwardly from said segments along and aligned with the longitudinal axes of said segments;

c) each segment comprising an outwardly facing airfoil with an outboard edge of each segment defining the airfoil leading edge d) lower edge surfaces of said airfoil being curled upon themselves behind said airfoil leading edges.

14. A throwable toy comprising:

a) an open center polygon having upper and lower surfaces and comprising a sufficient plurality of connected linear segments to produce a ring-like appearance;

b) a plurality of tabular shortened, generally rounded, rearward-projecting members extending outwardly and downwardly from and aligned with the longitudinal axes of said linear segments, peripheries of said tabular members being arcuate;

c) each segment comprising a radially outwardly facing airfoil having a leading edge with a continuously varying angle of attack along the segment longitudinal length, with the radially inboard trailing edges of the airfoils of said segments conforming to a single plane.

15. The toy of claim 14 wherein said members extend from longitudinal extremities of said segments.

16. The toy of claim 14 wherein said airfoil has varying angle of attack along segment length.

17. The toy of claim 16 wherein said angle of attack varies continuously along segment length.

18. The toy of claim 14 wherein said polygon is of uniform thickness except for at said airfoil leading edge.

19. The toy of claim 18 wherein said airfoil leading edge has a crescent shaped cross-section, with the curve of the crescent facing radially outwardly.

20. The toy of claim 18 further comprising a ballast member retained in place radially inboard of said airfoil leading edge by said edge wrapping at least part way around said ballast member.

21. The toy of claim 20 wherein said ballast member is manually replaceable.

22. A throwable toy comprising:

a) a closed ring having upper and lower surfaces; and b) a plurality of rounded, rearward-projecting members extending outwardly and downwardly from said ring, the peripheries of said members being arcuate;

c) said ring comprising an outwardly facing airfoil, with the ring inner surface defining the trailing edge of the airfoil, the leading edge of the airfoil being above the middle of said ring; and d) wherein said airfoil has varying angle of attack around said ring and wherein said angle of attack varies continuously around said ring.

23. A throwable toy comprising:

a) a closed ring having upper and lower surfaces; and b) a plurality of rounded, rearward-projecting members extending outwardly and downwardly from said ring, the peripheries of said members being arcuate;

c) said ring comprising an outwardly facing airfoil, with the ring inner surface defining the trailing edge of the airfoil, the leading edge of the airfoil being above the middle of said ring; and d) wherein said airfoil leading edge has a crescent shaped cross-section, with the curve of the crescent facing radially outwardly.

24. A throwable toy comprising:

a) a closed ring having upper and lower surfaces; and b) a plurality of rounded, rearward-projecting members extending outwardly and downwardly from said ring, the peripheries of said members being arcuate;

c) said ring comprising an outwardly facing airfoil, with the ring inner surface defining the trailing edge of the airfoil, the leading edge of the airfoil being above the middle of said ring; and d) a ballast member retained in place radially inboard of said airfoil leading edge by said edge wrapping at least part way around said ballast member.

25. The toy of claim 24 wherein said ballast member is manually replaceable.

26. A throwable toy comprising:

a) a closed ring having upper and lower surfaces;

b) a plurality of rounded, rearward-projecting members extending outwardly and downwardly from said ring, the peripheries of said members being arcuate;

c) said ring comprising an outwardly facing airfoil, with the ring inner surface defining the trailing edge of the airfoil, the leading edge of the airfoil being above the middle of said ring;

d) wherein said members are evenly spaced about said ring;

e) wherein said airfoil has varying angle of attack around said ring;

f) wherein said angle of attack varies continuously around said ring;

g) wherein said ring is of uniform thickness except for at said airfoil leading edge;

h) wherein said airfoil leading edge has a crescent shaped cross-section, with the curve of the crescent facing radially outwardly;

i) comprising a ballast member retained in place radially inboard of said airfoil leading edge by said edge wrapping at least part way around said ballast member; and j) wherein said ballast member is manually replaceable.

* * * * *